US006222931B1

(12) United States Patent
Cesati

(10) Patent No.: US 6,222,931 B1
(45) Date of Patent: Apr. 24, 2001

(54) HIGH POWER ACOUSTICAL TRANSDUCER

(76) Inventor: Mario Cesati, Via Privata de Vitalis, 16 - 25100 Brescia (IT)

( * ) Notice: Subject to any disclaimer, the term of this patent is extended or adjusted under 35 U.S.C. 154(b) by 0 days.

(21) Appl. No.: 07/891,852

(22) Filed: Jun. 1, 1992

Related U.S. Application Data

(63) Continuation-in-part of application No. 07/521,140, filed on May 8, 1990, now abandoned.

(30) Foreign Application Priority Data

Sep. 7, 1991 (IT) ..... 1229706

(51) Int. Cl.[7] ..... H04R 25/00

(52) U.S. Cl. ..... 381/427; 381/397; 381/423; 381/430

(58) Field of Search ..... 381/202, 194, 381/193, 200, 201, 199, 396, 397, 400, 401, 402, 403, 404, 407, 412, 420, 423, 424, 427, 430, FOR 154, FOR 162

(56) References Cited

U.S. PATENT DOCUMENTS

| | | | | |
|---|---|---|---|---|
| 2,392,143 | * | 1/1946 | Graham | 381/194 |
| 3,496,307 | * | 2/1970 | Sotome | 381/202 |
| 3,665,124 | * | 5/1972 | Satome | 381/202 |
| 3,991,286 | | 11/1976 | Henricksen . | |
| 4,122,314 | * | 10/1978 | Matsuda et al. | 381/193 |
| 4,135,601 | * | 1/1979 | Sotome | 181/167 |
| 4,140,203 | * | 2/1979 | Niguchi et al. | 181/167 |
| 4,146,756 | * | 3/1979 | Yamazaki et al. | 181/179 |
| 4,163,876 | * | 8/1979 | Ohnuki | 381/202 |
| 4,320,263 | * | 3/1982 | Thiele | 381/202 |
| 4,367,317 | * | 1/1983 | Yamaguchi et al. | 381/199 |
| 4,410,768 | * | 10/1983 | Nakamura et al. | 181/166 |
| 4,591,667 | * | 5/1986 | Hino et al. | 381/193 |
| 4,752,963 | * | 6/1988 | Yamazaki et al. | 381/193 |
| 5,062,140 | * | 10/1991 | Inanaga et al. | 381/202 |

FOREIGN PATENT DOCUMENTS

| | | | | |
|---|---|---|---|---|
| 0432693 | * | 6/1974 | (SU) | 381/155 |

* cited by examiner

*Primary Examiner*—Huyen Le
(74) *Attorney, Agent, or Firm*—McGlew and Tuttle, P.C.

(57) ABSTRACT

An electro-acoustic transducer comprises a metal single-piece blade diaphragm having a very good heat conductivity and mechanical characteristics, the metal blade of which is resiliently suspended and supports the acoustical current wire fixed at the center of mass thereof to the active metal surface of the transducer, so that the acoustical current wire communicates to the blade the heat which is produced because of the acoustical current and added to that generated in the blade because of the deformation of the resilient suspension.

20 Claims, 4 Drawing Sheets

HIGH POWER ACOUSTICAL TRANSDUCER

This is a continuation in part of the U.S. patent application Ser. No. 07/521,140 filed on May 8, 1990, now abandon in the name of the same Applicant.

FIELD OF THE INVENTION

The present invention relates to a high power diaphragm electro-acoustical transducer, of the movable-coil electrodynamic type, for transforming electrical signals into acoustical signals and for diffusing the latter.

BACKGROUND OF THE INVENTION

As is known, in electro-acoustical transducers for transforming electrical signals into acoustical signals and diffusing the latter, the vibrating member, which is electrically driven by the signal, consists of a diaphragm to the active surface thereof, that is that surface which effects the transmission medium, usually consisting of air, there is rigidly affixed, at the center of mass thereof, a conductor of the acoustical or sound current, i.e. a movable coil which is driven because of the inter-action between the acoustical current and a constant magnetic flux through the gap therein the conductor is arranged.

In general, a typical transducer for a middle-high range is provided with a diaphragm or membrane which essentially consists of an active substantially rigid curved surface, properly designed for the provided frequency spectrum, which is rigid with a supporting frame on which is rigidly affixed the movable coil.

The diaphragm comprises moreover a resilient suspension system, having a suitable resiliency for the frequency range to be reproduced; in other words, this resiliency has a value which, in the parameter system of the diaphragm, for example the provided masses, determines the condition for a linear acoustical reproduction up to the maximum amplitude of the applied signals, with a substantially even response through the overall range; there being moreover provided a peripheral ring member which restrains the movable equipment to the rigid structure of the unit.

More specifically, the rigid surface is provided by a light alloys blade, configured as a spherical cap, or the like, whereas the resilient suspension system comprises a ring member usually made of a thin plastic material, which material also forms the support member of the alluminium wire coil on which it is wound, and the restraining ring member.

For designing such a system, it is necessary to consider several practical requirements imposed by the latest developments in the electric-acoustical field (such as, for example, the great spreading of the recording dynamic range), and the consequent increase of the risk due to the required performance severity imposed to the system from the reliability standpoint.

The most important characteristic for an operating system is the capability of this system to support power, i.e. its capability to preserve, under extreme conditions, the qualitative and quantitative efficiency of less stringent requirements, so as to provide a continuous and even type of operation.

For a maximum power level, among the several chain components, from the starting electrical input signal to the transduced acoustical signal, is the electrical signal to acoustical signal converter which is the most affected component.

In order to bring this reasoning to a very elementary degree, (that is to reduce it, by anarithmetically speaking, to the "last terms"), let us consider a system in which the full acoustic frequency range has been practically divided into several sections, each controlled by a suitable characteristic transducer, and let us consider exclusively the transducer of the top end limit of the range, for example, from 3 k to 16 k Hz, that is that for which the subject reasoning will be clearly evident (naturally under the hypothesis that the considered range is not further subdivided).

For a faithfull reproduction or playback, as stated, apart other requirements which are herein neglected, there is necessary to provide a perfect linearity, that is an even ratio of the value of a parameter, for example the power of the input electrical signal, and that of the corresponding acoustical signal at the output of the transducer; and this for all of the frequencies: which means a substantially even response through the overall frequency range, that is with an offset less than ±2 dB.

If the values of the characteristics parameters of the transducer, in particular of those of the movable assembly, have been properly designed in order to provide the desired characteristics, it occurs that the conductor wire used for forming the movable coil will have an insufficient cross-section for supporting the current intensity corresponding to the maximum signals of a recursive average duration, with a consequent superheating; moreover, the diaphgram construction will have an insufficient thickness to resist against the stresses exerted thereon by the movable coil subject to its maximum displacements; on the other hand, its mass can not be increased to allow, considering the mass of the movable coil,a playback of the top limit of the sound frequency range practically devoid of any loss.

By concluding, if the transducer being considered is operated in extreme conditions, as it actually occurs, then the most deleterious drawbacks will be due to: a) the over-heating of the movable coil which is susceptible to deleteriously damage the movable assembly or equipment, because of the high temperature involved; b) the premature wear of the parts of the diaphragm structure, which are subjected to very high mechanical stresses, with a consequent heat generation, such as great stretching and binding deformations, characteristic of the resilient suspension system and mainly because of a very great tension stress to which the diaphgram is subjected along its coupling line to the diaphragm supporting unit, because of instantaneous pulses, even of moderate value, all of which will contribute to quickly put the transducer out of service.

Since it is not possible to increase, in a constant characteristic transducer, the mass of the diaphragm and movable coil, without negatively affecting the result, the single approach to be usedis that of efficiently and quickly dissipating, as fast as possible, the generated heat so as to hold the temperature of the diaphragm, for the provided operation type, under a risk level.

The U.S. Pat. No. 4,843,628 to Hofer discloses an inertial transducer comprising a housing containing therein a magnetic circuit including components thereof separated by a spring diaphragm wherein the flexing of the diaphragm causes the components to move toward and away from each other to induce a current in a coil. The spring diaphragm serves to separate the housing into tuned cavities the frequencies of which differ from each other and from that of the spring diaphragm. This transducer has frequency response peaks at the resonance frequences of the cavities and spring diaphgram.

The Hofer's transducer is not a movable coil transducer but is of the "movable iron" type and such transducer, being of a comparatively low power, does not present particular problems of efficiently dissipating the generated heat.

Thus, Hofer proposes a transducer the diaphragm of which is anchored to a metal mass and resiliently suspended and includes a corrugated portion providing a resilient suspension system, with a pheripheral ring element engaged under a top flat portion of the supporting unit and a central region therefrom a cylindric portion extends which in turn supports a movable electrically conductive coil which closely contacts the metal material of the diaphragm so that, as the transducer is operated the coil transmits to the diaphragm heat generated by the acoustical current passing through the coil in order to dissipate the generated heat: however, in this reference, the coil is not in contact with the metal material of the diaphragm and, on the contrary, from the drawings of this reference it would seem that the coil is insulated from the metal material of the diaphragm by means of a bobbin which is apparently made of an insulating material in order not to short circuit the turns of the coil.

The U.S. Pat. No. 4,709,392 tp Kato relates to modificationsof the diaphragm of an acoustical transducer, such as specifically designed holes therethrough, in order to controllably modify the higher order modes of operation and frequency response of the transducer.

Since also the Kato's transducer is of a comparatively low power, in this reference there is not addressed the problem of efficiently dissipating the generated heat.

The U.S. Pat. No. 4,752,963 to Yainazaky discloses an acoustical transducer in which the coil does not directly contact the diaphragm to transfer the heat generated by the coil to the adjoining metal mass: on the contrary, the peripheral anchoring of the coil is made by using a resilient material which, consequently, will provide a termal cut hindering the conduction of the generated heat to the metal mass of the magnetic circuit.

SUMMARY OF THE INVENTION

Accordingly, the aim of the present invention is to solve the above mentioned problems, by providing a high power diaphragm electro-acoustical transducer, of the movable-coil electrodynamic type, for transforming electrical signals into acoustical signals and diffusing the latter, which is adapted to efficiently dissipate the generated heat, both by irradiation and by conduction, in order to hold the temperature under a set risk level.

Within the scope of the above mentioned aim, a main object of the invention is to provide such a transducer which can be easily produced and which is adapted to resist against severe use conditions while providing a higher performance than the conventional diaphragms or membranes.

According to one aspect of the present invention, the above mentioned aim and objects, as well as yet other objects, which will become more apparent hereinafter, are achieved by high power diaphragm transducer according to the claims.

In such a transducer the acoustical current conductor will transmit to the blade member the heat generated by the acoustical current, which heat will be added to that generated in the blade member mainly because of the deformation of the resilient system during the operation; the heat being quickly absorbed by the metal blade member and efficiently dissipated by irradiating it into the air and by conduction through the adjoining masses, so as to hold the temperature under a set dangerous level.

BRIEF DESCRIPTION OF THE DRAWINGS

Further characteristics and advantages of the present invention will become more apparent hereinafter from the following detailed disclosure of the subject diaphragm, or membrane, transducer which is illustrated, by way of an indicative but not limitative example, in the figures of the accompanying drawings, where.

DESCRIPTION OF THE PREFERRED EMBODIMENTS

With reference to the figures of the accompanying drawings, the diaphragm or membrane according to the invention is characterized in that each portion of said diaphgram is made of a very good heat conductive material, having a very low density and suitable mechanical characteristics.

From preliminary tests on the diaphragm it has been found as preferable an aluminium alloy with a high magnesium contents; however, the processing of such an alloy, in order to obtain a diaphragm suitable for a mass production, has required a great designing effort and a particular processing method in order to obtain, from a blade member as that mentioned, having a thickness of few 1/100 of millimeter, susceptible to be highly work-hardened, a tridimensional object with different and partially opposite properties, distributed according to the function of the several parts.

Figure 1:
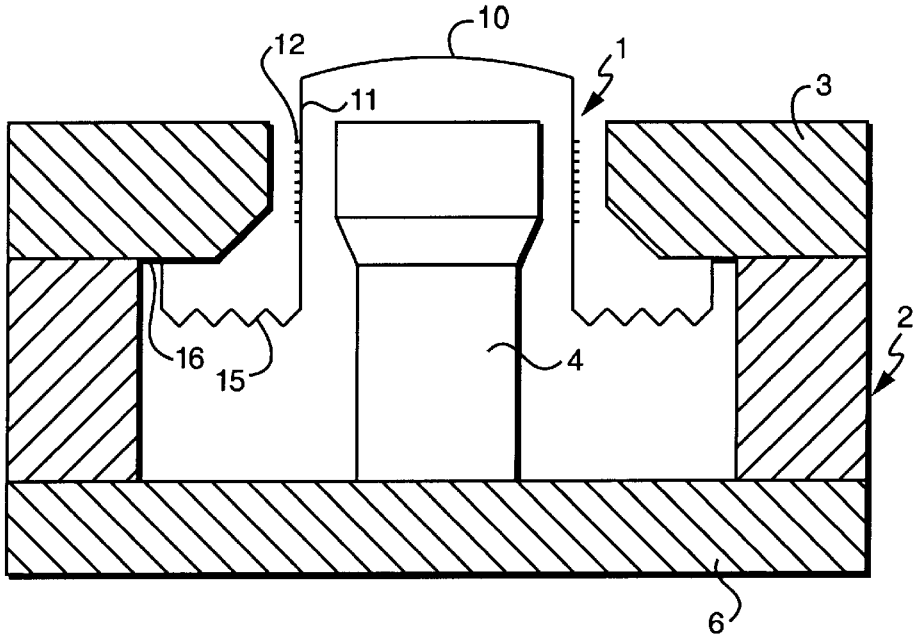
FIG. 1 is a schematic cross-sectional view illustrating a first embodiment of the diaphragm or membrane included in the transducer according to the present invention.

As shown in FIG. 1, the diaphragm, indicated generally at the reference number 1, is applied to a diaphragm supporting unit, generally indicated at the reference number 2.

The diaphragm has a central cap 10, or diaphragm active surface, of substantially rigid configuration for the provided frequency spectrum; from the zone 10 a cylindrical portion 11 extends thereon there is assembled a movable coil 12 which closely contacts the metal material of the diaphragm so that the heat generated by said coil will be quickly and efficiently absorbed and dispersed both by irradiation and by conduction through the metal mass to which the diaphragm is anchored.

The diaphgram is moreover provided with a waved portion, which provides a resilient suspension system, indicated at 15 and including a peripheral ring element 16 coupled under or inside the top flat edge portion 3 of the unit 2, which includes a central permanent magnet pole portion 4 arranged in the magnetic circuit and made of a high permeability iron, consisting of the portions 2, 3, 5 and 6.

The thus designed diaphragm has been subjected to severe operation tests and extreme conditions, and it has been found that this diaphragm has very high performance characteristics, with respect to conventional diaphragms.

The aluminium alloy which has been used for making the subject diaphragm is AlMg7, with a thickness of 0.05 mm;

the diaphragm has been constructed according to three embodiments for 500–8000, 800–10,000 and 2,000–16,000 Hz, with an active surface of convex and concave cap configuration having respectively a diameter of 55, 50 and 34 mm. In this connection it should be apparent that, for making the diaphragm, another alloy can be used provided that it has the above defined characteristics.

Figure 2:
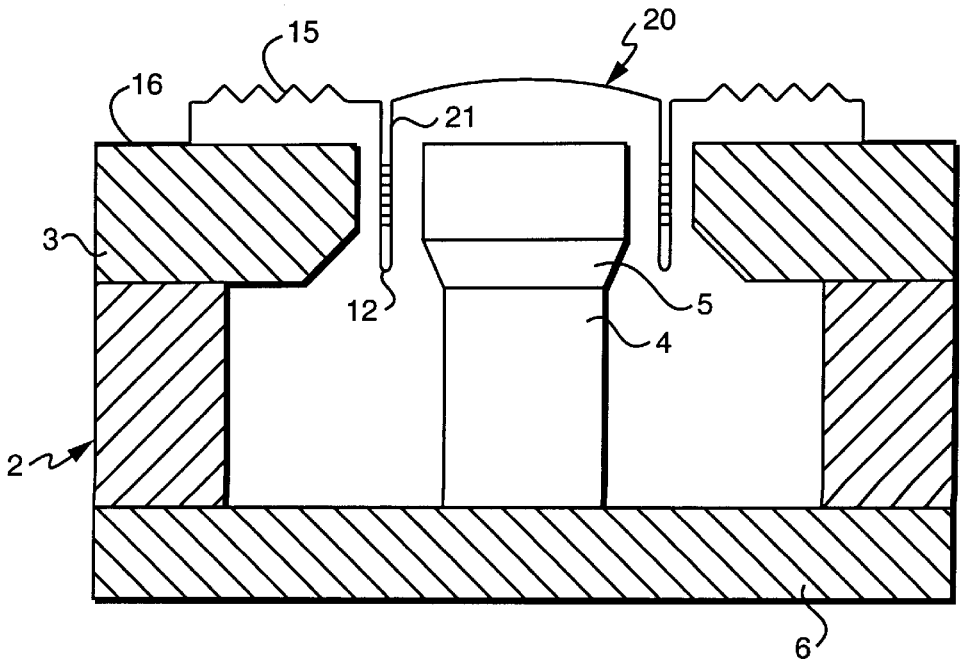
FIG. 2 shows a different embodiment of the diaphragm according to the invention.
Figure 3:
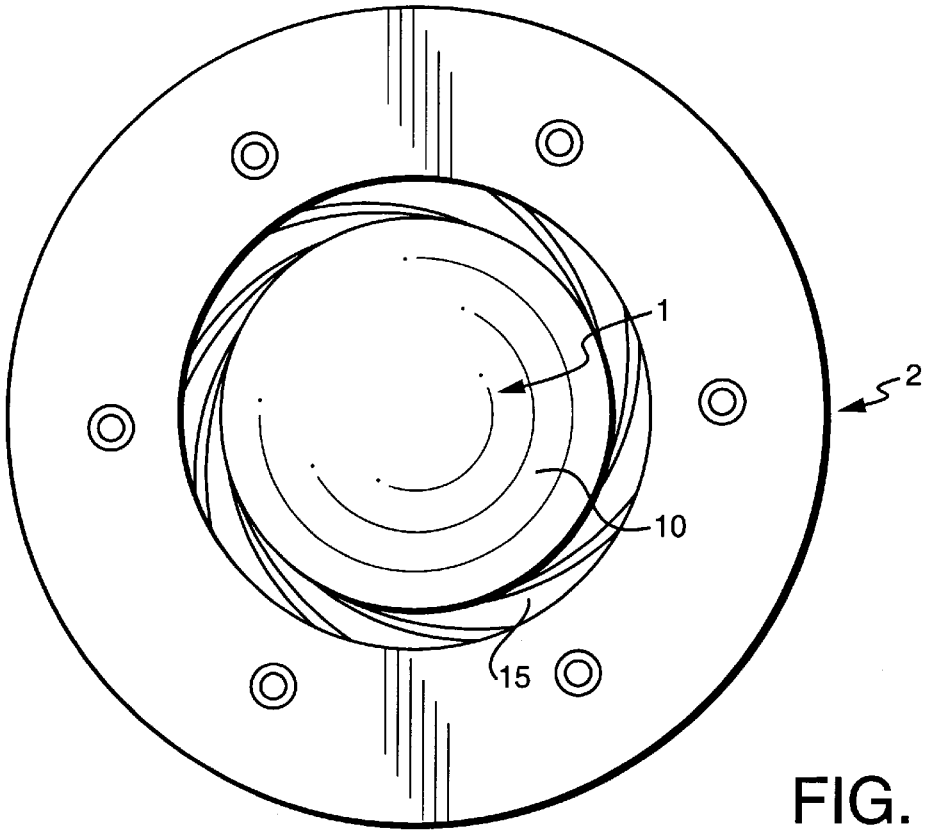
FIG. 3 is a top plan view of the diaphragm shown in FIG. 1.
Figure 4:
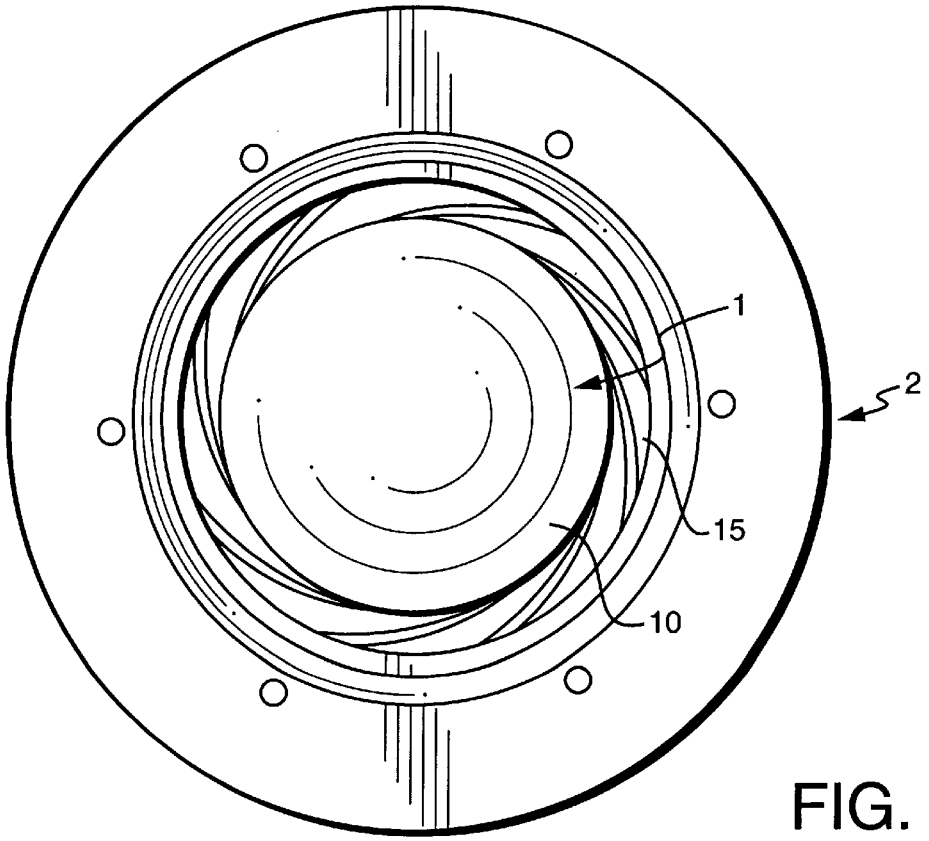
FIG. 4 is a bottom view of the diaphgram shown in FIG. 1.

As shown in FIG. 2, since the diaphragm is made in a single piece, with the three components or parts thereof disposed in the precise order: active surface, gap movable coil, peripheral resilient ring member, the active surface will be arranged on the top and the resilient suspension zone will be arranged under the flat portion closing the magnetic circuit.

Then, during the assembling operation, the diaphragm will be arranged in its position before the flat portion, which will prevent the diaphragm from being removed and replaced without demagnetizing the unit, which operation can not be easily performed remotely from the shop and which requires, in the unit, the provision of a field coil: however, from this undesirable characteristic no drawback derives for the reliability of the device.

As shown in FIG. 2, the diaphragm, indicated generally at the reference number 20, according to a more complex and delicate embodiment thereof, carries into practice the inventive idea.

In fact, the blade member, indicated at 20, is provided, between the resilient zone and cap, which are always indicated at the same reference numbers used in FIG. 1, with a loop structure 21 for housing the movable coil. From the construction standpoint, the blade member must be looped on itself so as to reach and cover, by a second layer, the already formed cylindrical portion, the base of the cap, and must then be bent through 90°, in order to form the resilient suspension system which, in the case being disclosed, advantageously comprises eleven crimping legs, of spiral shape, which are incised in the metal material in a symmetrical way in the overlapping and underlaying portions so as to simultaneously hold the static planarity of the ring member unchanged.

The cylindrical portion projecting from the cap base, with a very thin gap between the two portions forming it, is adapted to closely receive the movable coil: on the outside or on the inside of it or, preferably, in the gap between the two metal layers.

Figure 5:
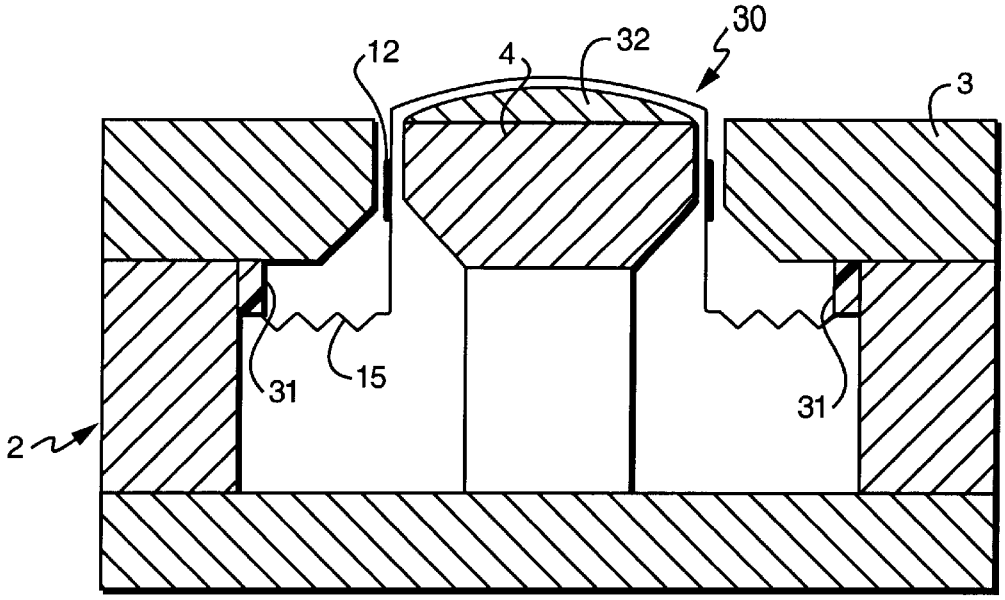
FIG. 5 illustrates yet another embodiment of the diaphragm according to the invention.
Figure 6:
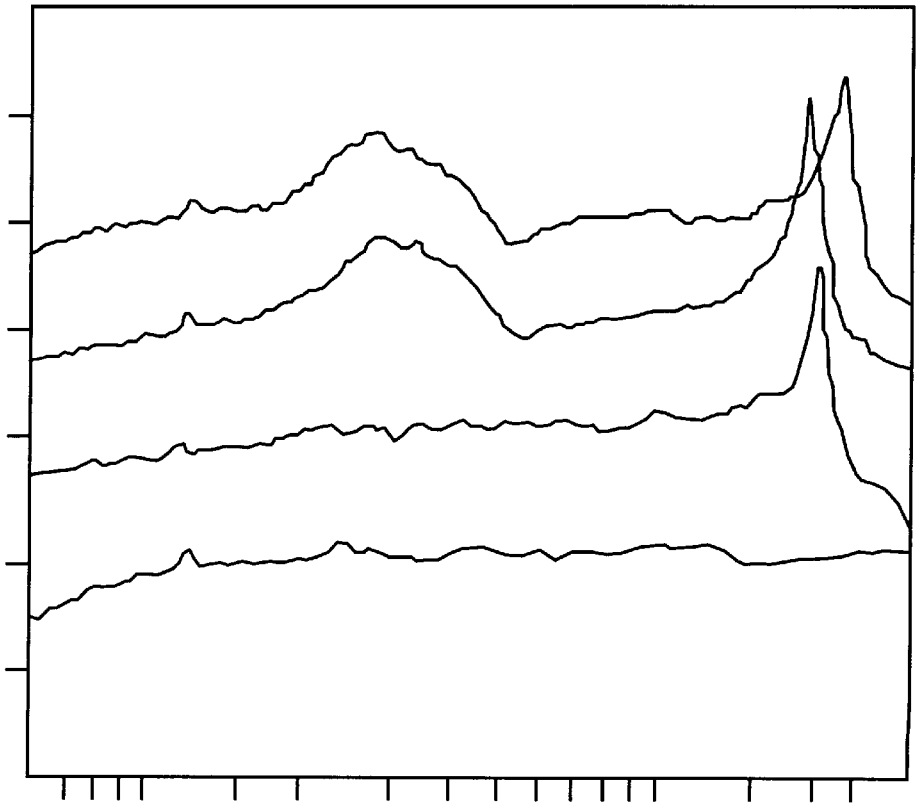
FIG. 6 shows a graph of the diaphragm response, in which on the abscissa axis there are shown the frequencies, while on the ordinate axis there are shown the pressure in dB's.
Figure 7:
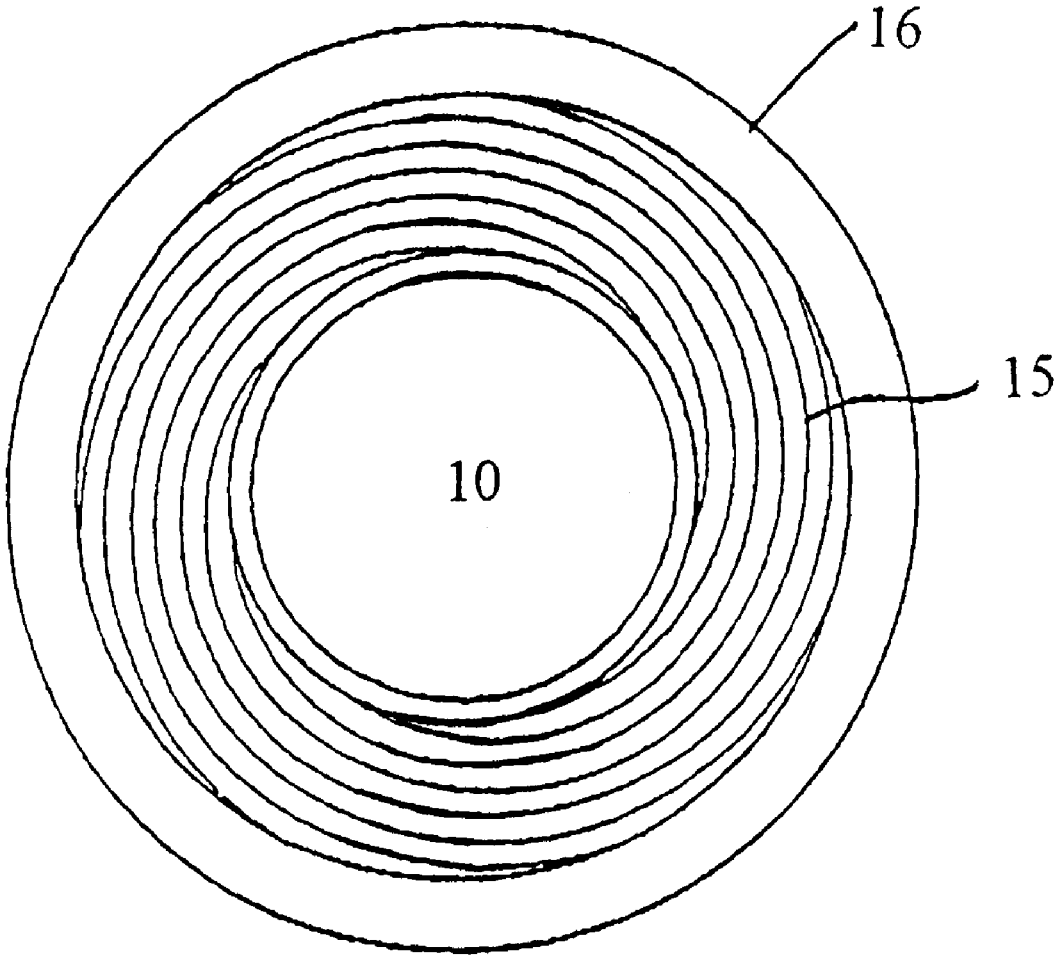
FIG. 7 shows an embodiment of the present invention with spirals.

FIG. 5 shows a different embodiment of the diaphragm, indicated at 30, which is conceptually similar to that shown in FIG. 1, with the single modification related to the shape of the central pole shoe of the magnetic circuit since, above said pole shoe, under the diaphragm cap, there is arranged a solid member 32 made of a non magnetic magnetic material which defines the profile at a small distance so as to provide a small volume compression chamber adapted to increase the stiffness of the movable assembly (without affecting the mechanical strength thereof), so as to provide a more even response through the overall range.

According to a preferred embodiment, for a wave range from 1,000 to 20,000 Hz, the active surface of the diaphragm has a spherical cap shape having a base diameter of 34 mm, the weight of the movable portion of the diaphragm being 510 mgr.

The diaphragm is made of an AlMg7 alloy, with a rubber damper 31 on the peripheral ring member of the undulated or corrugated portions; the movable coil has 30 turns, on two layers of copper wire of 0.12 mm diameter and, at 800 Hz, has an impedance of 8 ohm.

It has been found that, the value of the other parameters being the same, when the bending radius of the cap was changed from 35 to 20 mm, the main resonance toward the top limit of the acoustical range passes from 9,500 to 35,000 Hz with a negligible loss of the acoustical frequencies before the resonance region.

Moreover, the shown recording, which relates to the transducer of FIG. 1, must be considered with great attention since the diagrams of substantially uneven configuration represent the responses obtained from the transducer of FIG. 2, which has not been modified, with diaphragms having a cap bending radius of respectively 23 and 29 mm.

Under the above mentioned diagrams there are shown the response diagrams, of very high evenness, which have been obtained from the same transducers by suitably increasing, in both cases, the stiffness of the movable assembly system, without increasing the mechanical strength and accordingly the impedence thereof: this has been obtained by providing, in the rear hollow of the diaphragm cap, a compressione chamber having size and shape characteristics suitably designed for the two cases. More speicifically, the greater resulting stiffness is such asto selectively compensate, in several point of the spectrum, the different performance of the diaphragm at this point, so as to provide a substantially even acoustical output pressure.

From the above disclosure it should be apparent that the present invention fully achieves the intended aim and objects.

In particular, the fact is to be pointed out that the subject diaphragm, which is made of a single piece very thin blade member, provides great advantages with respect to the conventional diaphragms, mainly with respect to the evenness of the characteristics of the single diaphragm portions.

In particular, the acoustical transducer therein taught, in order to efficiently dissipate the generated heat, further includes cushioning or damper means, which have been thereinabove disclosed, susceptible to change the resonance characteristic of the transducer: in fact, by cushioning the vibration of the diaphragm, the main sesonance frequency of the system can be greatly changed both in amplitute and value.

Another important effect of this cushioning means is that they hinder a possible impulsive excessive displacement of the diaphragm in a case of a poor overload condition; in this case, the provision of the damper prevents permanent deformation of the resilient system from occurring or a mechanical breakage of the diaphragm on its periphery at the region where it is rigidly anchored to its supporting structure.

This, as stated, represents further important advantages which are not provided by the prior art references herein mentioned.

While the invention has been disclosed and illustrated with reference to a preferred embodiments thereof, it should be apparent that the disclosed embodiments are susceptible to several modifications and variations all coming within the spirit and scope of the appended claims.

What is claimed is:

1. A diaphragm electric-acoustic transducer, of the movable-coil electrodynamic type, comprising a transducer single piece diaphragm made of a high heat conductivity metal material and having a thickness from 0.04 to 0.07 mm, said diaphragm being directly connected to a metal mass forming a support unit and resiliently suspended on and coupled to said supporting unit, said diaphragm including a corrugated portion providing a resilient suspension system, said diaphragm also including a peripheral ring portion engaged under a top flat portion of said supporting unit and a central region forming a cylindrical portion, said cylindrical portion supporting a movable electrically conductive coil which closely contacts said high heat conductivity metal material of said diaphragm so that, as said transducer is operated, said coil transmits to said diaphragm heat generated by an acoustical current passing through said coil to quickly and efficiently dissipate said heat by irradiation and conduction through said metal mass;

a rubber damper element adapted to dampen said diaphragm to change a residence characteristic of said transducer.

2. A transducer according to claim 1, wherein said metal material is selected from a group including light AlMg alloys, and titanium.

3. A transducer in accordance with claim 1, wherein:

said single piece diaphragm is a single sheet of said high heat conductivity metal material.

4. The transducer in accordance with claim 3, wherein:

said single sheet is primarily a two dimensional object.

5. The transducer in accordance with claim 4, wherein:

said two dimensional object has first and second primary dimensions;

a third dimension or thickness of said two dimensional object is insignificant in relation to said first and second dimensions.

6. The transducer in accordance with claim 1, wherein:

said coil is in contact with said diaphragm.

7. The transducer in accordance with claim 1, wherein:

said coil and said diaphragm are formed to transform an electrical signal into an acoustical signal.

8. An electric-acoustic transducer comprising:

a pole portion;

a support unit formed of metal and surrounding said pole portion, said pole portion and said support unit defining a gap;

a diaphragm surrounding said pole portion and having a peripheral ring portion at an outer periphery attached to said support unit, said diaphragm having a corrugated portion adjacent said peripheral ring portion, said diaphragm also having a cylindrical portion on an opposite side of said corrugated portion from said peripheral ring, said diaphragm also having a cap portion extending across an end of said cylindrical portion, all of said diaphragm, including said peripheral ring portion, said corrugated portion, said cylindrical portion and said cap portion being formed in a single integral piece from a high heat conductivity metal for oscillating with respect to said support unit, said single piece diaphragm is a single sheet of said high heat conductivity metal;

an electrically conductive coil attached to said cylindrical portion of said diaphragm, said coil transmits to said diaphragm heat generated by an acoustical current passing through said coil to quickly and efficiently dissipate heat generated by said coil through said metal diaphragm to said metal support unit.

9. A transducer in accordance with claim 8, wherein:

said peripheral ring portion is attached inside said support unit.

10. A transducer in accordance with claim 4, further comprising:

a solid member made of a non-magnetic material and positioned between said cap portion of said diaphragm and said pole portion, said solid member defining a profile at a small distance from the diaphragm to provide a small volume compression chamber for increasing a stiffness of said diaphragm.

11. The transducer in accordance with claim 8, wherein:

said single sheet is primarily a two dimensional object.

12. The transducer in accordance with claim 11, wherein:

said two dimensional object has first and second primary dimensions;

a third dimension or thickness of said two dimensional object is insignificant in relation to said first and second dimensions.

13. The transducer in accordance with claim 8, wherein:

said coil is in contact with said diaphragm.

14. The transducer in accordance with claim 8, wherein:

said coil and said diaphragm are formed to transform an electrical signal into an acoustical signal.

15. An electric-acoustic transducer comprising:

a pole portion;

a support unit formed of metal and surrounding said pole portion, said pole portion and said support unit defining a gap;

a diaphragm surrounding said pole portion and having a peripheral ring portion at an outer periphery attached to said support unit, said diaphragm having a corrugated portion adjacent said peripheral ring portion, said diaphragm also having a cylindrical portion on an opposite side of said corrugated portion from said peripheral ring, said cylindrical portion contains a loop structure formed by the diaphragm being folded back on itself, said diaphragm also having a cap portion extending across an end of said cylindrical portion, all of said diaphragm, including said peripheral ring portion, said corrugated portion, said cylindrical portion and said cap portion being formed in a single piece from a high heat conductivity metal for oscillating with respect to said support unit, said single piece diaphragm being a single sheet of said high heat conductivity metal material;

an electrically conductive coil attached to said cylindrical portion of said diaphragm to transmit to said diaphragm heat generated by an acoustical current passing through said coil to quickly and efficiently dissipate heat generated by said coil through said metal diaphragm to said metal support unit.

16. A transducer in accordance with claim 15, wherein:

said peripheral ring portion of said diaphragm is attached to an outside of said support unit.

17. A transducer in accordance with claim 15, wherein:

said coil is positioned inside said loop structure.

18. The transducer in accordance with claim 15, wherein:

said single sheet is primarily a two dimensional object.

19. The transducer in accordance with claim 15, wherein:

said coil is in contact with said diaphragm.

20. The transducer in accordance with claim 15, wherein:

said coil and said diaphragm are formed to transform an electrical signal into an acoustical signal.

* * * * *

UNITED STATES PATENT AND TRADEMARK OFFICE

CERTIFICATE OF CORRECTION

PATENT NO. : 6,222,931 B1
DATED : February 21, 2002
INVENTOR(S) : Cesati

It is certified that error appears in the above-identified patent and that said Letters Patent is hereby corrected as shown below:

Title page,
Item [76], below Inventor, insert the following:

-- [73] Assignee: Outline S.N.C. Di Noselli G. & C.
Brescia, Italy --

Signed and Sealed this

Eighteenth Day of March, 2003

JAMES E. ROGAN
*Director of the United States Patent and Trademark Office*